US008628339B2

(12) United States Patent
Koga

(10) Patent No.: US 8,628,339 B2
(45) Date of Patent: Jan. 14, 2014

(54) FLEXIBLE PRINTED CIRCUIT CONNECTOR

(75) Inventor: Masahiro Koga, Osaka (JP)

(73) Assignee: FCI, Guyancourt (FR)

( * ) Notice: Subject to any disclaimer, the term of this patent is extended or adjusted under 35 U.S.C. 154(b) by 0 days.

(21) Appl. No.: 13/518,128

(22) PCT Filed: Dec. 16, 2010

(86) PCT No.: PCT/IB2010/003521

§ 371 (c)(1),
(2), (4) Date: Jul. 24, 2012

(87) PCT Pub. No.: WO2011/077265

PCT Pub. Date: Jun. 30, 2011

(65) Prior Publication Data

US 2013/0130518 A1 May 23, 2013

(51) Int. Cl.
*H01R 12/00* (2006.01)

(52) U.S. Cl.
USPC ..... 439/77

(58) Field of Classification Search
USPC ..... 439/77, 492–497, 260, 326–327
See application file for complete search history.

(56) References Cited

U.S. PATENT DOCUMENTS

| | | | | |
|---|---|---|---|---|
| 6,276,958 | B1 * | 8/2001 | Chih | 439/495 |
| 6,319,052 | B1 * | 11/2001 | Chang | 439/495 |
| 6,394,838 | B1 * | 5/2002 | Yen | 439/492 |
| 6,508,662 | B1 * | 1/2003 | Yu | 439/498 |
| 6,551,128 | B2 * | 4/2003 | Asai | 439/495 |
| 6,561,843 | B1 * | 5/2003 | Ma et al. | 439/495 |
| 6,939,166 | B2 * | 9/2005 | Chung | 439/495 |
| 7,112,089 | B1 * | 9/2006 | Liu et al. | 439/495 |
| 2002/0013086 | A1 * | 1/2002 | Inoue | 439/495 |
| 2003/0096530 | A1 | 5/2003 | Ma et al. | 439/495 |
| 2004/0067679 | A1 * | 4/2004 | Maejima | 439/495 |
| 2005/0118861 | A1 * | 6/2005 | Chung | 439/495 |

FOREIGN PATENT DOCUMENTS

| | | | |
|---|---|---|---|
| JP | 2008-147064 | A2 | 6/2008 |
| WO | WO 2008/004756 | A1 | 1/2008 |

* cited by examiner

*Primary Examiner* — Jean F Duverne
(74) *Attorney, Agent, or Firm* — Harrington & Smith

(57) ABSTRACT

The present invention relates to an electrical connector for connecting flexible printed circuit (FPC) boards. The connector has a housing and contact terminals disposed in the housing. An actuator is pivotally attached to the housing. The housing has a pair of retaining members between which a holding portion is defined. An FPC board is inserted into the holding portion and fixed to the housing by the actuator to establish electrical connection with the contact terminals. Each retaining member is supported by a metal bracket which is attached to the housing to increase the holding strength. The metal bracket has a main portion, a fixing portion and a support portion both expending perpendicularly from the main portion. A pair of lugs formed at side edges of the FPC board engage with the retaining members such that back movement of the FPC board from the housing is prevented.

8 Claims, 5 Drawing Sheets

FLEXIBLE PRINTED CIRCUIT CONNECTOR

TECHNICAL FIELD

The present invention relates to an electrical connector and in particular, to an electrical connector for connecting to a flexible printed circuit (FPC) board.

BACKGROUND

FPC connectors are widely used in electronic devices and systems to establish electrical connections between a flexible printed circuit board and a main circuit board. In addition to providing electrical connections, such connectors also mechanically attached the FPC together to prevent disconnection. A conventional FPC connector uses metal pieces to hold the FPC to the connector. During installation of the FPC to the connector, the FPC may be scratched by the metal pieces and hence the circuits on the FPC may be damaged.

It is therefore desirable to provide an FPC connector which is capable of reliably holding the FPC without scratching or damaging the FPC circuits.

SUMMARY OF INVENTION

Disclosed herein are electrical connectors for connecting flexible printed circuit (FPC) boards. In one embodiment, an electrical connector has a housing and contact terminals disposed in the housing. An actuator is pivotally attached to the housing. The housing has a pair of retaining members between which a holding portion is defined. An FPC board is inserted into the holding portion and fixed to the housing by the actuator to establish electrical connection with the contact terminals. Each retaining member is supported by a metal bracket which is attached to the housing to increase the holding strength. The metal bracket has a main portion, a fixing portion and a support portion both expending perpendicularly from the main portion. A pair of lugs formed at side edges of the FPC board engage with the retaining members such that back movement of the FPC board from the housing is prevented. The retaining member is disposed between the flexible printed circuit board and the bracket to prevent direct contact of the flexible printed circuit board and the bracket. A likelihood of scratch or damage to the FPC by the metal bracket is prevented.

BRIEF DESCRIPTION OF DRAWINGS

These and other aspects and advantages of the present invention will be described in detail with reference to the accompanying drawings, in which.

DETAILED DESCRIPTION OF THE PREFERRED EMBODIMENTS

Figure 1:
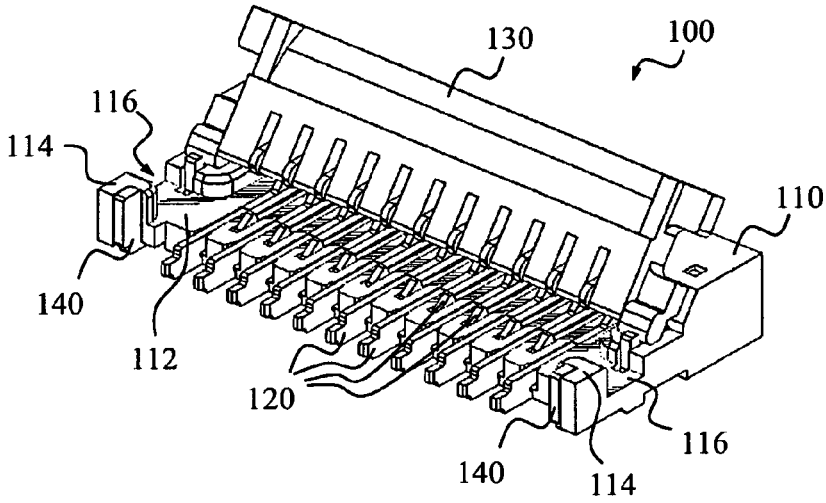
FIG. 1 is a perspective view of an electrical connector according to one embodiment of the present invention.

As shown in FIG. 1, an FPC electrical connector 100 according to one embodiment of the present invention has a housing 110 and contact terminals 120 disposed in housing 110. An actuator 130 is pivotally attached to housing 110 for fixing an FPC to connector 100. Housing 110 has a mounting surface 112 at which contact terminals 120 are partially exposed. At both side of mounting surface 112 there are provided a pair of retaining members or stoppers 114. Adjacent to each retaining member 114 there is formed a notch 116. A pair of metal brackets 140 is attached to housing 110. Each bracket 140 is attached to and supports a retaining member 114.

Figure 2:
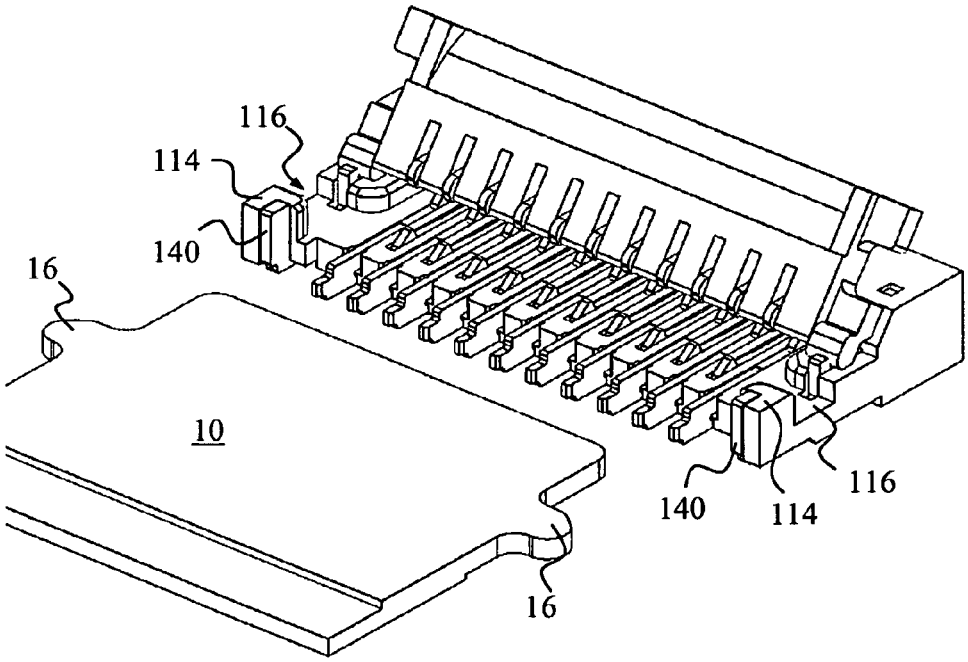
FIG. 2 is a perspective view of FIG. 1 and an FPC board to be connected thereto.
Figure 3:
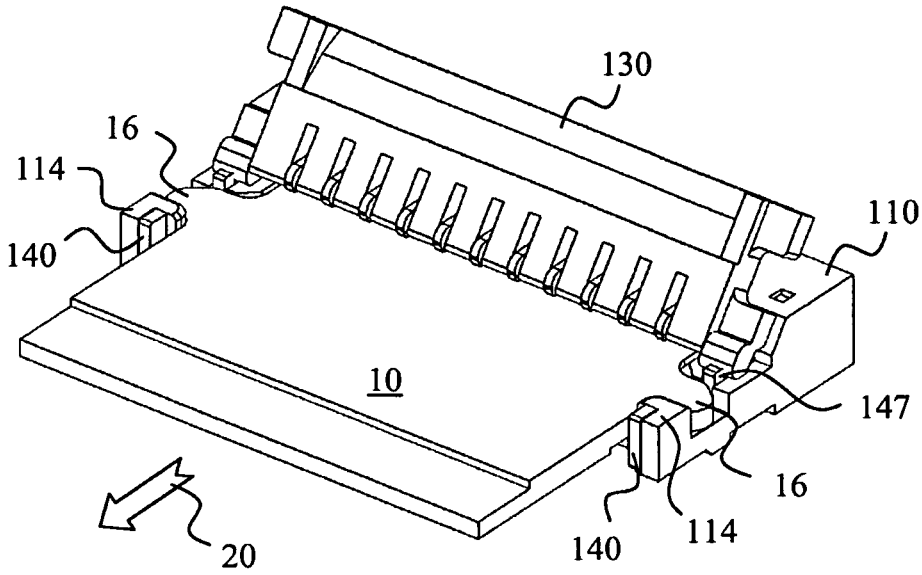
FIG. 3 is a perspective view of FIG. 2 when the FPC is attached to the connector.
Figure 4:
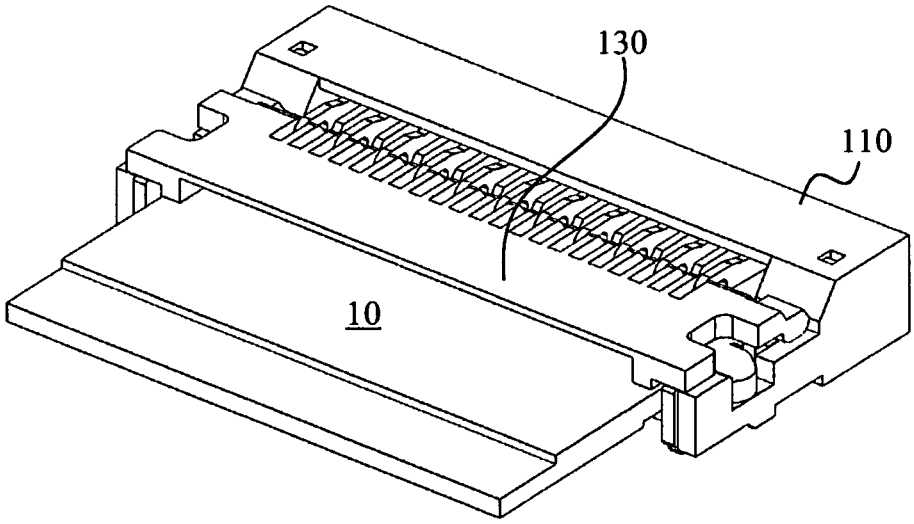
FIG. 4 is a perspective view of FIG. 3 when the FPC is fixed and connected to the connector.

As shown in FIGS. 2, 3 and 4, an FPC board 10 has a pair of lugs 16 formed at side edges. To connect to connector 100, FPC board 10 is placed on mounting surface 112, with the pair of lugs 16 received in the pair of notches 116. Due to the engagement between lugs 16 and retaining members 114, FPC board 10 is hold to housing 110 such that backward movement of FPC board 10, i.e. movement along a direction 20 depicted in FIG. 3, is prevented. Actuator 130 can then be closed to press FPC board 10 against mounting surface 112, to complete the assembly of FPC board 10 to connector 100, as shown in FIG. 4.

Figure 5:
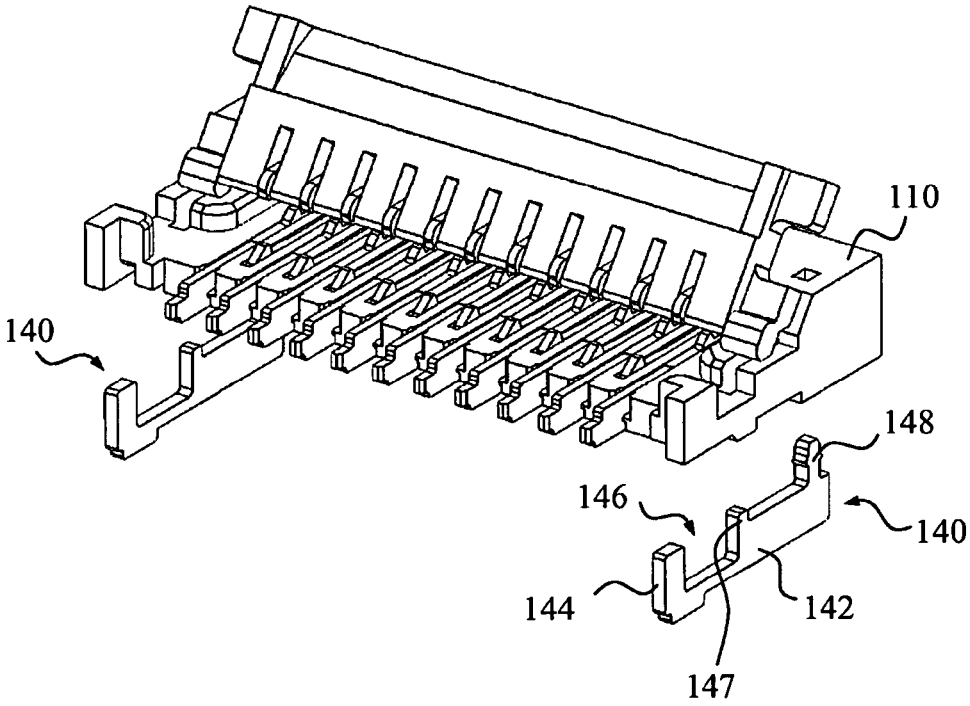
FIG. 5 is a partial exploded perspective top view of FIG. 1.
Figure 6:
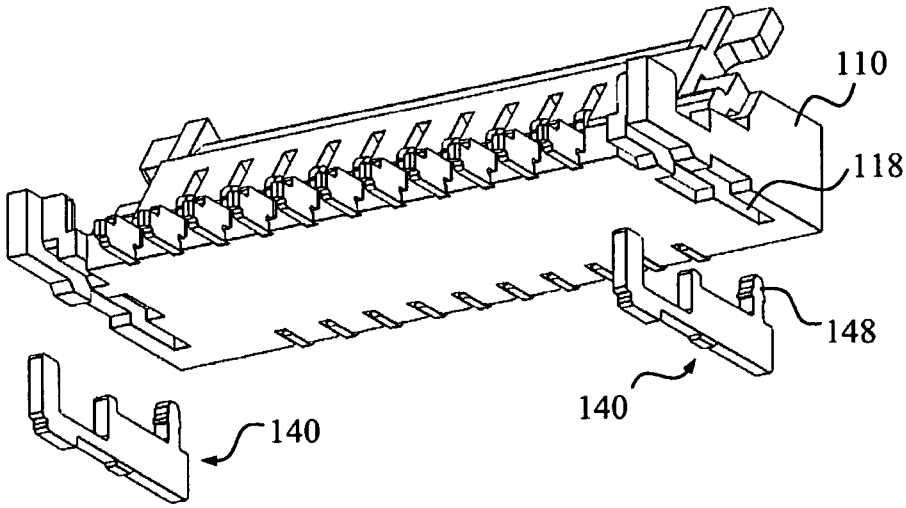
FIG. 6 is a partial exploded perspective bottom view of FIG. 1.

As shown in FIGS. 5 and 6, each bracket 140 has a main body 142, a holding projection 144 at one end, and a fixing projection 148 at another end. Holding projection 144 and fixing projection 148 are perpendicular to main body 142. Adjacent to holding projection 144 there is formed a recess 146.

At each side of housing 110, there are formed a groove 118, shown in FIG. 6, into which a bracket 140 is inserted and fixed to housing 110, to increase the strength and rigidity of retaining member 114. Holding projection 144 is placed adjacent to and support retaining member 114 in a manner that, there is no direct access to holding projection 144 from notch 116. Another word, a portion of retaining member 114 is positioned between holding projection 144 and notch 116. In addition, holding projection 144 is slightly shorter than retaining member 114 such that, when FPC board 10 slides on top surface of retaining member 114, for instance during installation of FPC 10 to housing 110, FPC board 10 will not touch holding projection 144 even if FPC board 10 contacts the top surface of retaining member 114. A likelihood of scratches to the FPC board by the brackets is therefore avoided, from the top surface of retaining member 144 or from notch 116 and possible damage to the FPC circuits is prevented.

As fixing projection 148 is perpendicular to main body 142, a pulling force caused by FPC board 10, along direction 20 shown in FIG. 3, will be well absorbed by brackets 140 via the engagement of lugs 16 and notches 116. Brackets 140 will not be detached from housing 110 by such pulling forces.

Retaining member 114 may also include an engaging projection 147 between holding projection 144 and fixing projection 148. When retaining member 114 is attached to housing 110, engaging projection 147 protrudes out of housing 110 to be in contact with actuator 130. During the process of FPC 10 installation to or removal from connector 100, actuator 130 is pivoted and supported by engaging projection 147, as shown in FIGS. 3 and 5. As such, engaging projection 147 provides stronger and reliable support to actuator 130, compared to conventional connector where actuator is only support by housing parts which may easily be worn off.

Figure 7:
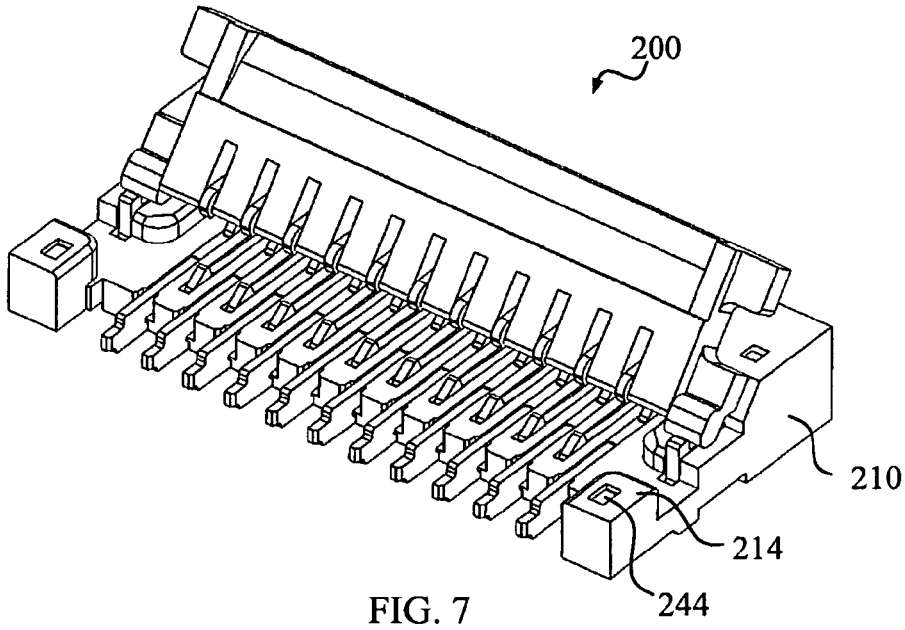
FIG. 7 is a perspective view of an electrical connector according to another embodiment of the present invention.
Figure 8:
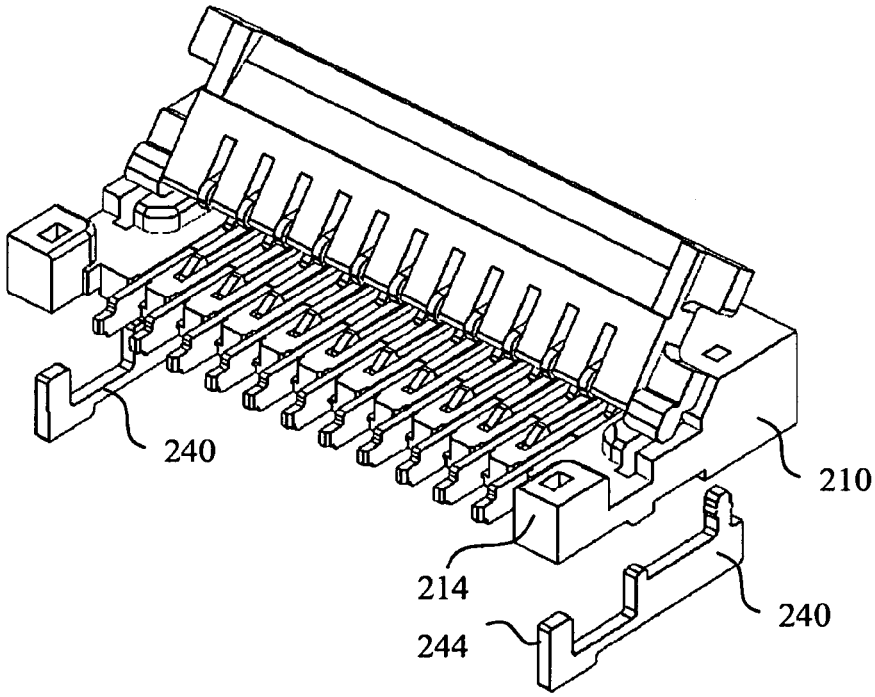
FIG. 8 is a partial exploded perspective top view of FIG. 7.

FIGS. 7 and 8 show another embodiment of the present invention. Variations from the previous embodiment are that, holding projection 244 of bracket 240 is inserted into a hole formed on retaining member 214, hence holding projection 244 is surrounded by retaining member 214, when bracket 240 is attached to housing 210. Accordingly there is no front access to bracket 240 as is the case of the previous embodiment. During installation process, an FPC board will not touch the bracket from front side of connector and therefore the present embodiment provides further protection measures.

Figure 9:
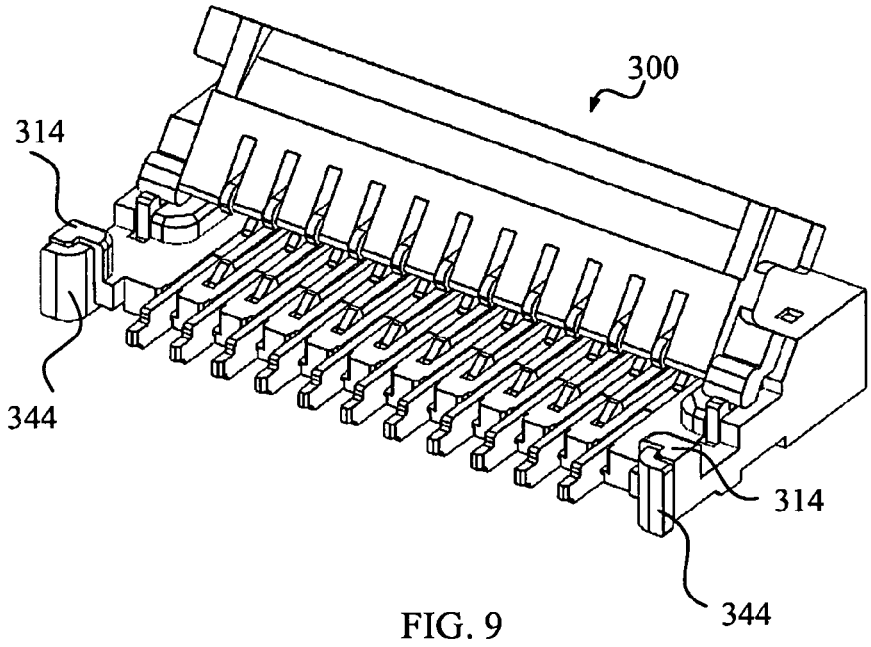
FIG. 9 is a perspective view of an electrical connector according to a further embodiment of the present invention.
Figure 10:
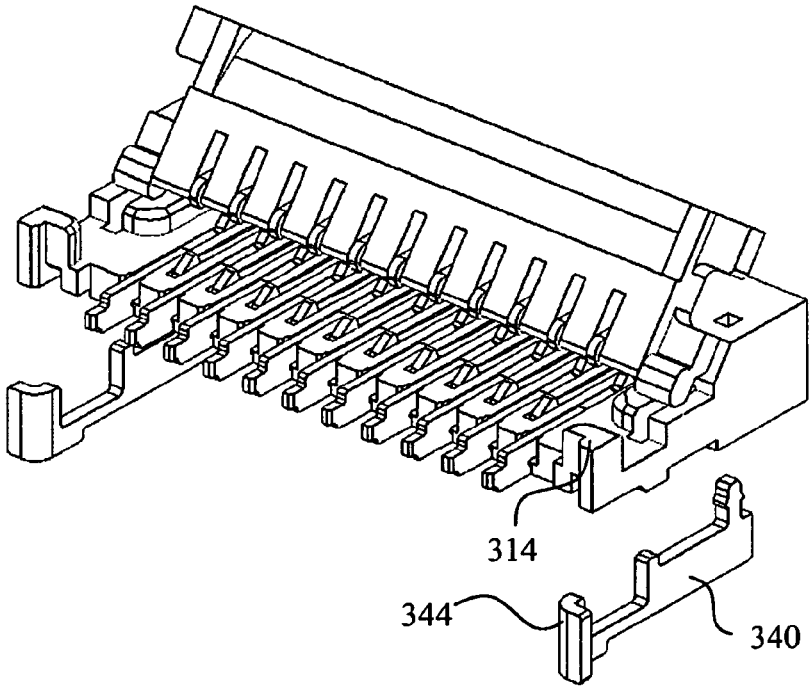
FIG. 10 is a partial exploded perspective top view of FIG. 9.

FIGS. 9 and 10 show a further embodiment of the present invention. In this embodiment, holding projection 344 of bracket 340 has an angled structure. Bracket of such structure has a relatively high rigidity, and allows holding projection 344 to surround a corner of retaining member 314, hence the strength and rigidity of retaining member 344 is further increased. This structure is useful when the physical dimensions of the connector is small in which the retaining members are thin and weak.

The invention claimed is:

1. An electrical connector comprising:

a housing having a pair of retaining members defining a mounting surface therebetween for receiving a flexible printed circuit board;

a plurality of contact terminals disposed in the housing;

a pair of brackets attached to the housing, each bracket supports a corresponding retaining member;

wherein when the flexible printed circuit board is received at the mounting surface, the retaining members engage with a pair of lugs provided on the flexible printed circuit board to prevent detachment of the flexible printed circuit board from the connector, and wherein a portion of the retaining member is positioned between the flexible printed circuit board and the bracket to prevent direct contact of the flexible printed circuit board and the bracket.

2. The electrical connector of claim 1, wherein each bracket includes a main body, a holding projection formed at one end of the main body, a fixing projection formed at another end of the main body, and a recess between the holding projection and the fixing projection, wherein the fixing projection is inserted into a groove of the housing, and the holding projection is attached to the retaining member.

3. The electrical connector of claim 2, wherein the holding projection is attached to an external side of the retaining member.

4. The electrical connector of claim 2, wherein the retaining member has a hole into which the holding projection is inserted such that the holding projection is surrounded by the retaining member.

5. The electrical connector of claim 4, wherein the holding projection is positioned below a top surface of the retaining member.

6. The electrical connector of claim 2, wherein the fixing projection has an angled structure which surrounds a corner of the retaining member.

7. The electrical connector of claim 2, further comprising a pair of notches each located between the housing and a respective retaining member, wherein the recess of the retaining member is positioned surrounding the notch.

8. The electrical connector of claim 2, further comprising an actuator pivotally mounted to the housing, wherein the retaining member further comprising an engaging projection between the fixing projection and the holding projection, wherein the engaging projection protrudes out of the housing to engage the actuator.

* * * * *